US009546085B2

(12) United States Patent
Baron et al.

(10) Patent No.: US 9,546,085 B2
(45) Date of Patent: Jan. 17, 2017

(54) ASSEMBLY FOR ENGAGING AND ACTIVATING A BARGUN DURING CLEANING OPERATION

(75) Inventors: Rick Baron, Zephyrhills, FL (US); Joshua Cox, Zephyrhills, FL (US); Steve Garbee, Brandon, FL (US); Steve Robbins, Land O'Lakes, FL (US)

(73) Assignee: Nestec S.A., Vevey (CH)

( * ) Notice: Subject to any disclaimer, the term of this patent is extended or adjusted under 35 U.S.C. 154(b) by 247 days.

(21) Appl. No.: 14/400,239

(22) PCT Filed: May 11, 2012

(86) PCT No.: PCT/US2012/037547

§ 371 (c)(1),
(2), (4) Date: Feb. 3, 2015

(87) PCT Pub. No.: WO2013/169267

PCT Pub. Date: Nov. 14, 2013

(65) Prior Publication Data

US 2015/0136180 A1 May 21, 2015

(51) Int. Cl.

| | |
|---|---|
| ***B08B 9/00*** | (2006.01) |
| ***B67D 1/08*** | (2006.01) |
| ***B67D 1/16*** | (2006.01) |
| ***B67D 1/00*** | (2006.01) |
| ***B67D 1/07*** | (2006.01) |

(52) U.S. Cl.

CPC ..... *B67D 1/0889* (2013.01); *B67D 1/0042* (2013.01); *B67D 1/0084* (2013.01); *B67D 1/0086* (2013.01); *B67D 1/07* (2013.01); *B67D 1/16* (2013.01); *B67D 2001/075* (2013.01); *Y10T 29/49815* (2015.01); *Y10T 29/49826* (2015.01); *Y10T 137/6851* (2015.04)

(58) Field of Classification Search

None

See application file for complete search history.

(56) References Cited

U.S. PATENT DOCUMENTS

| | | | |
|---|---|---|---|
| 2008/0217357 | A1 | 9/2008 | Hecht |
| 2009/0277927 | A1 | 11/2009 | Schroeder |
| 2011/0286883 | A1 | 11/2011 | Hecht |

FOREIGN PATENT DOCUMENTS

| | | |
|---|---|---|
| EP | 2364951 | 9/2011 |

OTHER PUBLICATIONS

International Preliminary Report on Patentability issued in PCT/US2012/037547. Mailed Nov. 20, 2014. 6 pages.

*Primary Examiner* — Eric Golightly
(74) *Attorney, Agent, or Firm* — K&L Gates LLP

(57) ABSTRACT

The invention concerns an assembly (1) for engaging and activating a bargun (2), the bargun having a handle (21) with at least one button (22, 23) on its upper surface (24) and a nozzle (25) perpendicular to the handle, the assembly comprising:—a draining body (11) presenting:. an opening (111) for receiving the bargun nozzle,. an outlet (112) configured for being connected to the drain,—a bargun holding bracket (12) attached to the draining body, said bracket defining a space (s) for holding the handle and the free end (121) of said bracket being configured for activating the at least one button on the upper surface of the handle when the handle is slid in said space.

7 Claims, 2 Drawing Sheets

ASSEMBLY FOR ENGAGING AND ACTIVATING A BARGUN DURING CLEANING OPERATION

CROSS REFERENCE TO RELATED APPLICATIONS

The present application is a National Stage of International Application No. PCT/US2012/037547, filed May 11, 2012, the entire contents of which are being incorporated herein by reference.

FIELD

The present invention relates to the cleaning of barguns.

BACKGROUND

Barguns are typically comprised of a handle having a multiplicity of buttons thereon and a nozzle situated typically perpendicular to the handle, for dispensing a preselected fluid. Bar guns are well-known in the art. Nozzles of bar guns are typically cylindrical and are attached at a near end to the handle and have a fluid dispensing opening at a removed end thereof. It is known in the art to provide a holster for engaging a bargun, typically for encircling the nozzle of a bar gun, when the bar gun is not in use. The use of a holster, with a nozzle opening dimensioned slightly larger than the nozzle of a typical bar gun, allows the bar gun user to "holster" or place the bar gun in a non-use position, in much the same way the holster of a handgun will engage at least a portion of the barrel and leave the handle exposed, for use by the wearer. US 2009/0277927 describes such bargun holster.

The process for cleaning a bargun consists in having a cleaning fluid dispensed through the bargun. The bargun is supplied with a source of cleaning fluid and the operator presses the dispensing buttons of the bargun until a defined volume of cleaning fluid has been dispensed. It means that during this cleaning operation the operator has to hold the bargun dispenser to press the buttons. Such an operation can last several minutes and for an optimal cleaning up to one hour, which is perceived as a long time for the operator who must activate the bargun. For this reason the operators tend to not correctly clean the bargun in particular by decreasing the cleaning time during which the cleaning fluid circulates through the bargun.

The object of the present invention is to propose a device for helping the operator during the cleaning operation and forcing him to correctly execute the cleaning operation of the bargun.

SUMMARY

According to a first aspect, the invention concerns an assembly for engaging and activating a bargun, the bargun having a handle with at least one button on its upper surface and a nozzle perpendicular to the handle, the assembly comprising:

- a draining body presenting:
  - an opening for receiving the bargun nozzle,
  - an outlet configured for being connected to the drain,
- a bargun holding bracket attached to the draining body, said bracket defining a space for holding the handle and the free end of said bracket being configured for activating the at least one button on the upper surface of the handle when the handle is slid in said space.

The present invention applies to any bargun presenting a handle with at least one button on its upper surface and a nozzle perpendicular to the handle. Most of the time, the handle presents several buttons on its upper surface. The nozzle perpendicularly extends from the handle. The nozzle usually presents a cylindrical shape.

The assembly for engaging and activating the bargun comprises a draining body for simultaneously receiving the bargun nozzle and directing any fluid delivered by the nozzle to the draining body outlet that is configured for being connected to the drain. Preferably the opening for receiving the bargun nozzle is placed on the upper side of the draining body according to its normal orientation during the cleaning operation as shown for example in the figures.

According to an embodiment the opening for receiving the bargun nozzle in the draining body is chamfered.

According to another embodiment a draining tube is attached to the outlet of the draining body.

According to the invention the draining body comprises a bracket attached to the draining body. The bracket is attached so that it defines a space between the draining body upper side and the bracket upper side and said space approximately corresponding to the thickness of the handle with the handle buttons being activated In order to help the introduction of the handle in the space defined between the bracket and the draining body, the free end of the bracket is configured for pushing the at least one button during said introduction. Preferably the free end of the bracket is upwardly inclined.

According to a first aspect, the invention concerns a method for cleaning a bargun having a handle with at least one button on its upper surface and a nozzle perpendicular to the handle by means of an assembly such as described hereabove comprising the following steps:

- optionally dismantling any spigot attached to the bargun nozzle,
- positioning the outlet nozzle in the opening of the draining body of the assembly,
- rotating the handle towards the bracket so as to engage the handle in the space defined by the bracket and to have the at least one button of the handle activated by the bracket.

The method can also comprise the preliminary steps of:

providing a supply of cleaning fluid to the bargun, and connecting the outlet of the draining body to drain.

BRIEF DESCRIPTION OF THE DRAWINGS

The characteristics and advantages of the invention will be better understood in relation to the following figures.

DETAILED DESCRIPTION OF THE DRAWINGS

Figure 1:
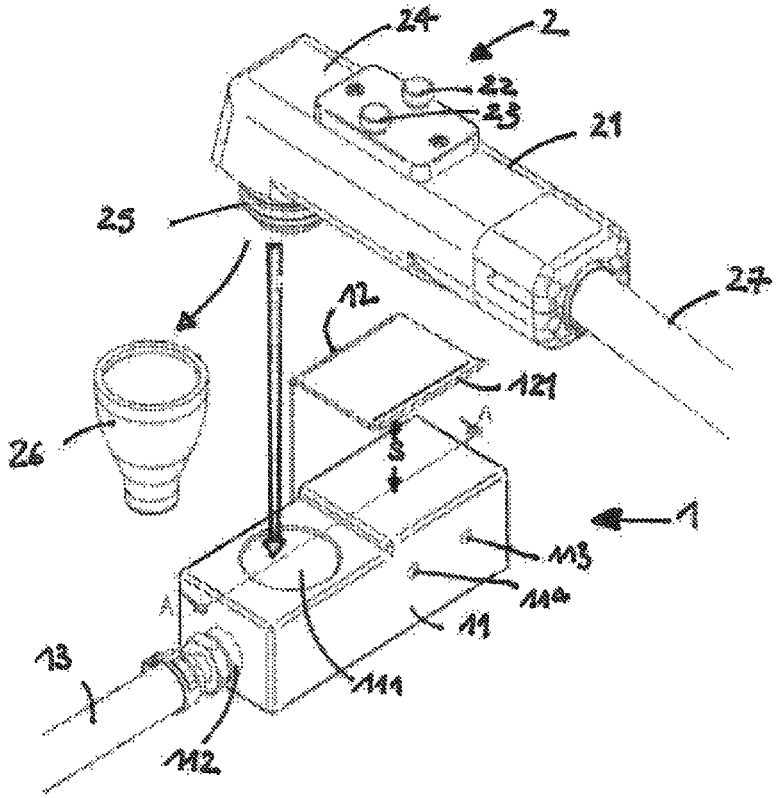
FIG. 1 is a perspective view of the bargun and the assembly according to the present invention.
Figure 2:
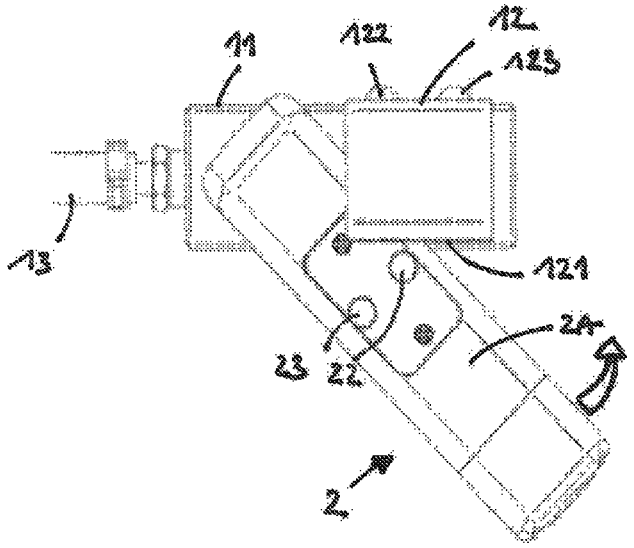
FIG. 2 is a perspective view of the bargun and the assembly illustrating the engagement of the bargun in the assembly.

FIG. 1 illustrates a bargun 2 comprising a handle 21 with two buttons 22, 23 on its upper surface enabling the dispensing of two different beverages though the nozzle 25 perpendicular to the handle. In beverage dispensing operation a spigot 26 can be attached to the nozzle for directing the flow of beverage; it can also be used to improve the mixing of the beverage ingredients delivered by the nozzle e.g. a syrup and a diluent, or a beverage base and a flavor ingredient. The spigot is preferably dismountable from the nozzle 25. It can be attached through a screw connection or pressed on. A tube 27 is attached at the other side of the handle and holds the beverage supply tubes.

Figure 3:
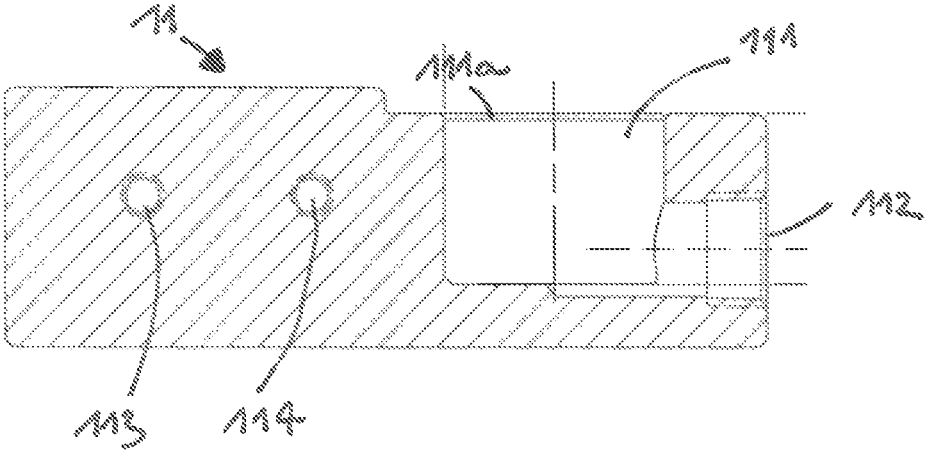
FIG. 3 is a section view of the draining body 11 of the assembly 1 according to AA.

FIG. 1 also illustrates the assembly 1 for engaging and activating the bargun 2. The assembly comprises a draining body 11 presenting an opening 111 on its upper side. This opening is configured for receiving the bargun nozzle 25. Consequently the opening 111 is preferably circular. It presents a chamfered edge 111*a* (illustrated in FIG. 3) so as to improve the tightness with the nozzle 25 when the latter is connected to the assembly 1. The draining body 11 comprises an outlet 112 attached to a drain tube 13. FIG. 3 illustrates the internal part of the draining body 11: it is made apparent that the draining body simply directs the fluid delivered by the nozzle connected to the opening 111 to the draining body outlet 112 that is configured for being connected to the drain.

The assembly 1 also comprises a bargun holding bracket 12 attached to the draining body 11. The bracket 12 can be attached by any means to the draining body. In the illustrated embodiment the bracket 12 is attached by means of two screws 122, 123 fitting in corresponding holes 113, 114 of the draining body. Said holes are traversing the draining body 11 so that it is possible to attach the bracket 12 either one or the other lateral side of the draining body. The bracket 12 that is attached to the draining body 11 defined a space s between the upper side of the draining body and the upper part of the bracket. The height of this space s is fixed so that the handle 21 can be positioned in this space with the upper part of the bracket activating the buttons 22, 23. In order to activate the buttons, the free end 121 of the bracket is upwardly inclined. Consequently during the movement of sliding the handle 21 in the space s the buttons are gradually pressed by the inclined end and slid in this pressed state under the upper side of the bracket.

The cleaning operation of the bargun 2 with the assembly 1 is now going to be described.

The operation for cleaning the bargun 1 with the assembly of the present invention consists in first optionally removing the spigot 26 from the nozzle as illustrated in FIG. 1 and approaching the bargun 2 to the assembly 1. Depending on the type of bargun that is used valve(s) may be activated and/or a sanitizing container may be filled with a cleaning solution in order to provide a supply of cleaning fluid to the bargun 2 through the tube 27.

Then the bargun nozzle 25 is applied on the opening 111 as illustrated by the arrow in FIG. 1 and then the bargun handle 21 is rotated towards the bracket 121 so that it is engaged in the spaces. During this rotation the buttons 22 and 23 are successively gently pressed by the inclined end 121 of the bracket and, at the end of the rotation, are maintained pressed by the upper part of the bracket. In this final position, due to the activation of the buttons, the fluid delivered by the tube 27 is delivered through the bargun 2. If this fluid is a cleaning fluid, the internal parts of the bargun are cleaned. The bargun can be maintained in this cleaning position as long as there is a supply of cleaning fluid. Such an operation can last up to one hour. During this time the operator is free for other operations whereas in the state of the art he had to press on the buttons of the bargun. In particular the operator can be free for preparing another batch of cleaning solution since usually different type of cleaning solutions must flow through the bargun (e.g. detergent composition, sanitization composition, rinsing water).

Thanks to the draining block the cleaning solution dispensed by through the nozzle is properly directed to the drain. This assembly acts as both an extension to the drain line (yet bargun doesn't reach the drain) and an on/off mechanism for the cleaning process.

The assembly and the method of the present invention present the advantage of facilitating the sanitization process of a bargun and make it more convenient by allowing the user hands free operation and reducing the fatigue of the operator while performing sanitization. Consequently it encourages the operator to regularly and properly clean the bargun.

Another advantage of the invention is that it prevents the operator from having the bargun reached the drain. The cleaning operation is made properly.

Another advantage of the invention is that it allows the bargun to drain directly to the drain without using an intermediate container avoiding risk of operator strain while emptying or moving buckets and splashing around the bargun.

The final advantage of the invention is that it will help to ensure that the beverage consumer will have a clean safe drink.

The invention claimed is:

1. An assembly for engaging and activating a bargun, the bargun having a handle with at least one button on its upper surface and a nozzle perpendicular to the handle, the assembly comprising:

a draining body comprising:

an opening for receiving the bargun nozzle, an outlet configured for being connected to a drain, and a bargun holding bracket attached to the draining body, the bracket defining a space for holding the handle and a free end of the bracket being configured for activating the at least one button on the upper surface of the handle when the handle is slid in the space.

2. The assembly according to claim 1, wherein the free end of the bracket is upwardly inclined.

3. The assembly according to claim 1, wherein the opening for receiving the bargun nozzle in the draining body is chamfered.

4. The assembly according to claim 1, wherein a draining tube is attached to the outlet of the draining body.

5. A method for cleaning a bargun having a handle with at least one button on its upper surface and a nozzle perpendicular to the handle, using an assembly comprising: a draining body comprising: an opening for receiving the bargun nozzle, an outlet configured for being connected to a drain, and a bargun holding bracket attached to the draining body, the bracket defining a space for holding the handle and a free end of the bracket being configured for activating the at least one button on the upper surface of the handle when the handle is slid in the space, the method comprising the steps of:

positioning an outlet of the nozzle in an opening of the draining body of the assembly; and rotating the handle towards a bargun holding bracket so as to engage the handle in the space defined by the bracket and to have the at least one button of the handle activated by the bracket.

6. The method according to claim 5 comprising the steps of:

providing a supply of cleaning fluid to the bargun, and connecting the outlet of the draining body to drain.

7. The method according to claim 5 comprising the step of dismantling any spigot attached to the bargun nozzle.

* * * * *